United States Patent [19]

Nakasugi et al.

[11] 4,142,713

[45] Mar. 6, 1979

[54] METHOD OF HEAT-TREATMENT OF WELDED PIPE AND APPARATUS THEREFOR

[75] Inventors: Hajime Nakasugi, Kisarazu; Tsurugi Kimura, Kimitsu; Teruo Tanimoto, Kisarazu; Tsutomu Sakimoto, Kimitsu, all of Japan

[73] Assignee: Nippon Steel Corporation, Tokyo, Japan

[21] Appl. No.: 797,116

[22] Filed: May 16, 1977

Related U.S. Application Data

[63] Continuation-in-part of Ser. No. 634,327, Nov. 21, 1975, abandoned.

[30] Foreign Application Priority Data

Dec. 26, 1974 [JP] Japan ..... 49/136512

[51] Int. Cl.[2] ..... C21D 9/14

[52] U.S. Cl. ..... 266/87; 73/15 FD; 148/127; 148/128

[58] Field of Search ..... 73/15 FD, 340, 355 R; 148/127, 128, 150; 228/231, 232; 266/87

[56] References Cited

U.S. PATENT DOCUMENTS

| | | | |
|---|---|---|---|
| 3,020,745 | 2/1962 | Sielicki | 73/15 FD |
| 3,247,364 | 5/1966 | Waziri | 73/340 X |
| 3,427,861 | 2/1969 | Maley | 73/15 FD |
| 3,796,849 | 3/1974 | Cuvelier | 219/8.5 X |
| 3,824,366 | 7/1974 | Garnier | 219/10.77 |
| 3,873,830 | 3/1975 | Forster | 219/10.77 X |
| 3,915,763 | 10/1975 | Jennings et al. | 148/127 |
| 4,011,054 | 1/1977 | Makepeace | 148/127 X |

*Primary Examiner*—Howard N. Goldberg
*Assistant Examiner*—Paul A. Bell
*Attorney, Agent, or Firm*—Wenderoth, Lind & Ponack

[57] ABSTRACT

In the method of heat-treatment of welded pipe having a reinforcement weld bead therealong by heating the pipe by using an induction heating device and then by cooling it, the bead which has just been heated by the induction heating device, is further heated by a bead heater to a temperature such that the temperature difference between the metal of the pipe and the bead is smaller than a temperature difference which will produce a bad influence on the quality of the pipe.

In the apparatus for heat-treatment of welded pipe having a reinforcement weld bear therealong by heating and then by cooling the pipe respectively by a heating device and a cooling device arranged in the direction of travel of the pipe, there is provided between the heating device and the cooling device a temperature-difference detector for detecting the temperature difference between the metal of the pipe and the bead, and also a bead heater for heating the bead so as to make the temperature difference between the metal of the pipe and the bead smaller than the aforementioned temperature difference.

5 Claims, 19 Drawing Figures

METHOD OF HEAT-TREATMENT OF WELDED PIPE AND APPARATUS THEREFOR

This is a continuation-in-part of Ser. No. 634,327, filed Nov. 21, 1975, now abandoned.

BACKGROUND OF THE INVENTION

The present invention relates to an improvement in a method of and an apparatus for heat-treatment of welded pipe having a reinforcement weld bead therealong by heating the pipe uniformly by using an induction heating device and then by cooling it.

In producing large-diameter steel pipe by a process such as the so-called UO process, it is necessary to apply a heat-treatment to the pipe which has been welded at the abutted edges of the sheet which has been formed into the shape of the pipe in order to secure desired properties of the pipe. As a heating device for such heat-treatment, there is utilized an induction heating device because of its rapid heating capacity and high operating efficiency. However, just after the heating of the welded pipe by an induction heating device for carrying out the heat-treatment, the temperature of the bead of the pipe is generally lower than that of the metal of the pipe itself. FIGS. 1*a* and 1*b* show the temperature distribution of the bead and the area around the bead. The following are known facts about such temperature distribution: if the thickness of the bead, and hence the reinforcement rate ($2\ \Delta\ t/t$) is great, the temperature distribution appears as shown in FIG. 1*a;* and if the rate is small, the temperature distribution appears as shown in FIG. 1*b*. The maximum temperature difference $\Delta T$ max is, say, 100° to 200° C. Any great temperature difference between the base metal and the bead affects the quality of the treated pipe adversely, making it necessary to control such difference within an allowable limit for securing the desired quality of the treated pipe.

The allowable limit for the temperature difference varies according to heat-treatment methods; one example being ±10° C. for treatment at 950° C.

As a means for making the temperature difference between the pipe metal and the bead smaller, there is conventionally utilized a longer time for heating the welded pipe, during which time heat conduction in the pipe makes the difference smaller.

However, as shown in FIG. 2, the layout of the conventional heat-treatment apparatus using an induction heating device, has feed rollers 1 and 2, an induction heating coil 3 and a cooling device 4 for continuous heat-treatment of the welded pipe. In such a treatment line, however, there is the limit on the distance between feed rollers depending on the length of the treated pipe (in most cases, 6–20 m) and also on the distance between the heating coil 3 and the cooling device 4 depending on the heat-treatment methods and the efficiencies thereof. The length of the heating device itself is restricted. Therefore, the means to make the temperature difference smaller merely by lengthening the heating time may sometimes be impracticable under various restrictive conditions.

Another means for making the temperature difference smaller is preheating of the bead before the heating of the pipe for heat-treatment, by using such devices as a gas torch or induction bead heater, such as disclosed in U.S. Pat. No. 3,804,390. However, as a result of the experiments conducted by the inventors of the present invention, such means has the following drawbacks:

(a) The heat used for pre-heating the bead before heating the whole of the pipe by the induction heating coil diffuses in the direction of the pipe circumference while it passes the cooling device after the induction heating coil, making the temperature of the part of the pipe metal adjacent to the bead higher than that of the bead itself, resulting in excessive heating of said part of the pipe metal. Therefore, as the pipe becomes cool and contracts, deformation is concentrated at said part which has been excessively heated, the thus produced deformation being much greater than in other parts, degrading the resulting pipe with respect to roundness of the cross-section of the pipe by as much as 20 to 30 mm in a diameter of 700 mm, as compared with 15 mm when the bead is not pre-heated.

(b) In general, the higher the frequency of the current supplied to the induction heating coil, the higher the heat concentration but the shallower the depth of penetration of the heat. Also, the lower the temperature of the heated object, the shallower the depth of penetration of the heat. Thus, in the method comprising preheating of the bead before heating the whole of the pipe, uniform heating only of the bead in the direction of its thickness, cannot be attained if a high frequency current is used, in view of the relationship with said heat concentration and the depth of penetration of the heat. As a result, the frequency appropriate for the pipe wall thickness of 10 mm is 50 to 150 Hz.

(c) Heat control can be carried out only with difficulty because of the long distance between the position for controlling and that of cooling.

(d) Not only the bead but also the area around the bead is heated, such widened area of heating reducing heat efficiency.

SUMMARY OF THE INVENTION

In view of the above described drawbacks of the conventional technology in this field, the present invention has been developed with an object of providing a method of and an apparatus for the heat-treatment of welded pipe which is capable of controlling the temperature-difference between the pipe metal and the bead within such a range as to obtain a good effect from the heat treatment.

Another object of the present invention is to provide a method of and an apparatus for heat treatment of welded pipe, whereby welded pipe is heated with a high heating efficiency.

A further object of the present invention is to provide an apparatus for heat-treatment of welded pipe operating completely automatically with high accuracy and consistently.

In order to attain these objects, the method of heat-treatment of welded pipe according to the present invention is characterized in that in the method of heat-treatment of welded pipe having a reinforcement weld bead by heating the pipe by using an induction heating device and then by cooling it, the bead which has just been discharged from the induction heating device is further heated by a bead heater for controlling to within the allowable limit the temperature difference between the pipe metal and the bead just after heating the entire pipe.

In order to practice said method effectively, the apparatus for heat-treatment of welded pipe according to the present invention has a heating device and a cooling device arranged in the direction of travel of the pipe, and between the heating and cooling device is a temperature-difference detector for detecting the temperature difference between the pipe metal and the bead, and also a bead heater for heating the bead so as to make the temperature difference between the pipe metal and the bead depending on the temperature difference detected by said temperature difference detector.

DESCRIPTION OF THE PREFERRED EMBODIMENT

Figure 3:
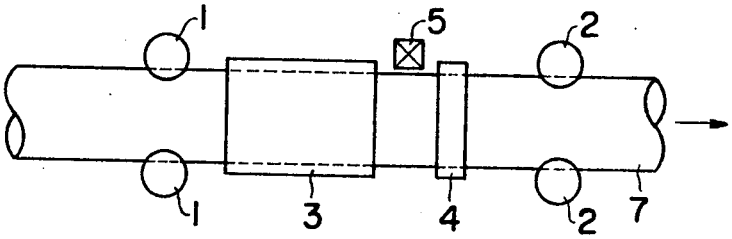
FIG. 3 is a schematic illustration of one embodiment of the apparatus for practising the method of the present invention.

FIG. 3 shows one example of a lay-out of the heat treatment apparatus for pipe made by the UO process for practising the method of the present invention, in which there are spaced sets of feed rollers 1 and 2 between which is an induction heating coil; 3 and a cooling device 4 for cooling pipe 7 which has been rapidly heated by the induction heating coil 3 and a bead heater 5 is provided between the induction heating coil 3 and the cooling device 4 for selectively heating the bead of the pipe 7.

The procedure of the method of the present invention is as follows: The pipe 7 which has been discharged from the welding step is subjected to the treatment process with the devices arranged as shown in FIG. 3, that is, the entire pipe 7 is heated by the induction heating coil 3 so that it rapidly reaches a desired temperature; then the bead which should have a lower temperature than the pipe metal, is subjected to local heating by the bead heater 5 to reduce the temperature difference between the pipe metal and the bead and make it smaller than an allowable limit within which there will be no bad influence of such difference on the quality of the treated pipe. The reason why according to the present invention the bead can be reheated by the bead heater 5 just after being heated by the induction heating coil 3, that is, only the bead is selectively heated after the whole pipe structure including the bead has been heated, is that the temperature difference between the pipe metal and the bead after the whole pipe has been heated can be accurately detected without difficulty, making it possible to control such temperature difference so that it is within the allowable limit, and to reduce time requirement before cooling; therefore, heat patterns can be produced without difficulty, resulting in little danger of over-heating or under-heating.

In said embodiment of the present invention, a high-frequency induction heating coil is used as the bead heater in the bead heating device, but there are many other devices, such as a gas torch or other fuel burners or a plasma arc or a laser that can be used as the bead heater. Therefore, such means as described above can be used depending on the size of the pipe, pipe making conditions, the space for installation of the heater and the capacity thereof.

The foregoing describes the heat treatment of pipe made by the UO process, but the same procedure is applicable to pipe made by other processes, say, a spiral process. In this case, the direction of bead travel and the direction of the pipe axis do not correspond; therefore, the bead heater should be also provided along the path of the travel of the bead.

Figure 4:
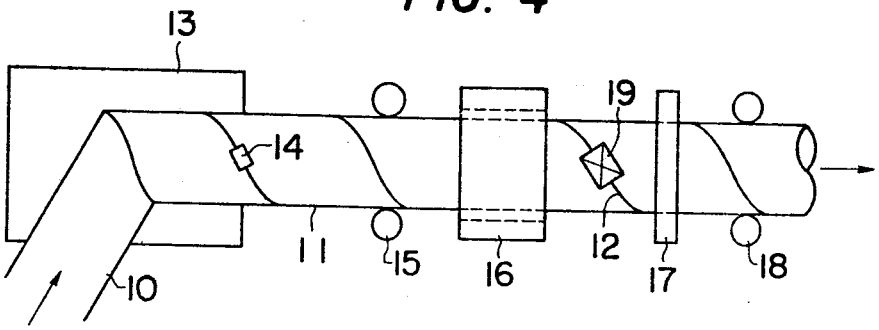
FIG. 4 is a schematic illustration of the layout of the apparatus of the present invention as applied to pipe made by the spiral process.

The following is a description of the practice of the method of the present invention on pipe made by a spiral process:

In FIG. 4, 13 denotes a spiral pipe forming stand; 11 denotes the steel pipe which is made by spirally winding a steel sheet 10; 14 denotes an outside welder; 15 denotes supporting rollers; 16 denotes an induction heating coil mounted on the same axis as the pipe forming stand 13; 17 denotes a cooling nozzle means provided behind the induction heating coil 16; and 18 denotes pinch roller.

In said apparatus, steel pipe 11 which has been welded after being formed by the pipe forming stand 13, is transported into the induction heating coil 16 through the supporting roller 15, to be heated to a desired heat-treatment temperature. There is provided a bead heating device 19 between the induction heating coil 16 and the cooling nozzle 17. The bead heating device 19 is provided at a fixed position along the line of movement of the bead 12, and said device 19 should be so further devised as to follow the changes in the path of movement of the bead.

As described above, the bead is heated between the induction heating coil 3 and the water cooling nozzle means 4 according to the present invention, so that there is very little heat diffused from the bead until the pipe 7 is cooled, the whole of the pipe including the bead being heated uniformly, so that there is no deformation due to excessive heating such as described above. Also, when the whole of the pipe has been heated by the induction heating coil 3 to a high temperature, say, a temperature higher than Curie point, local heating of the bead causes heat to penetrate very deeply into the bead, ensuring uniform heating of the bead in the direction of its thickness, even when applying a current of such high frequency as 1000 to 3000 Hz. Furthermore, the bead is heated just before cooling the pipe according to the present invention, so that the temperature of the bead can be controlled very easily, that is, the bead is heated with high controllability of the application of the heat. Therefore, the practice of the present invention makes it possible to accurately and easily control the temperature difference between the pipe and the bead within the allowable limit as desired, thus attaining the desired properties of the treated pipe. This procedure can be applied to the conventional heat treatment process, thus making it of greater commercial value.

In the practice of said heat treatment process, the apparatus for heat treatment should desirably be so constructed that a temperature-difference detecting mechanism for detecting the temperature difference between the pipe metal and the bead (for example, a radiation pyrometer or the like, which is movable so as to traverse the bead over the certain range for detecting the temperature of the area around the bead) is provided between the bead heater and the heating coil, and the thus detected temperature difference is used for controlling output of the bead heater to bring the bead temperature within the allowable limit.

Figure 1B:
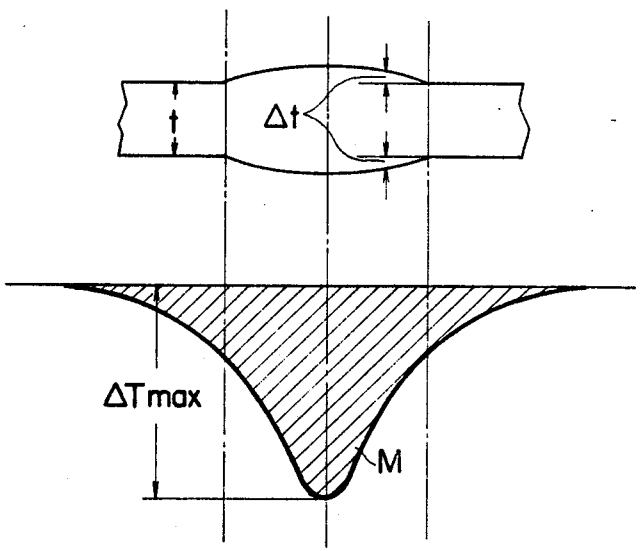
FIGS. 1*a* and 1*b* show the temperature distribution in the bead and the area around it where the whole of the pipe is heated and the bead is not locally reheated.
Figure 1A:
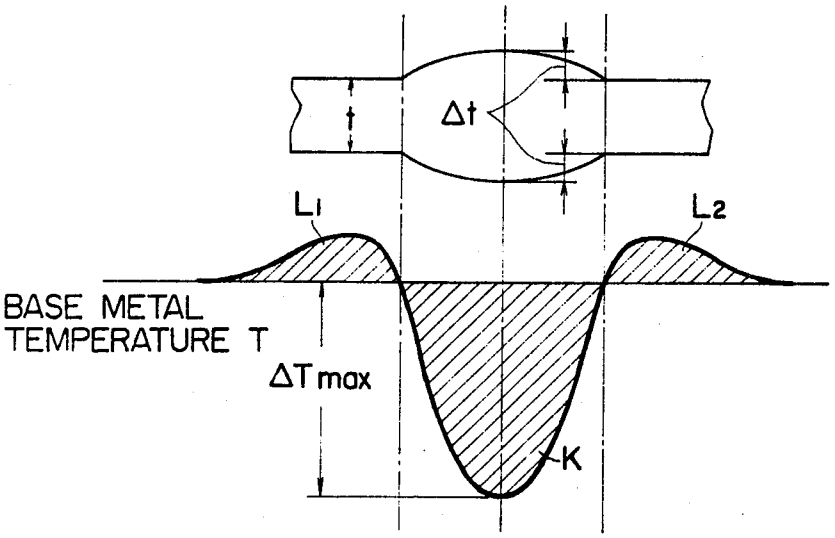
Figure 2:
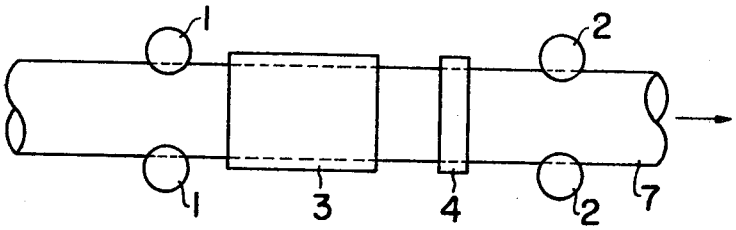
FIG. 2 PRIOR ART
FIG. 2 is a schematic illustration of the layout of an inducation heat-treatment apparatus of the conventional type.

The temperature difference between the pipe metal and the bead which is thus detected or controlled is generally the maximum temperature difference $\Delta T$ max shown in FIG. 1, but the invention is not limited thereto. For instance, an integrated value of temperature, that is, an area $K-L_1-L_2$ in the case of FIG. 1*a* or an area M in the case of FIG. 1*b*, can be used as the value representing such temperature difference. If necessary, an additional bead position detecting mechanism may be used, which is connected with a position following mechanism set on the bead heater so that the bead heater will operate all the time at its best capacity at the best location.

Figure 5:
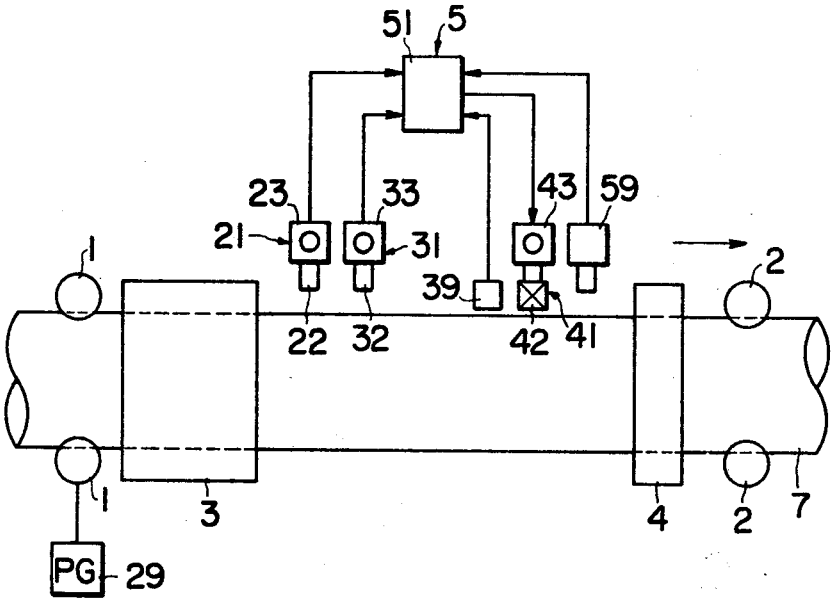
FIG. 5 is a schematic front view of one embodiment of the heat-treatment apparatus of the present invention.

The following is a detailed description of said apparatus: As shown in FIG. 5, the bead heating device 5 provided between the induction heating coil 3 and the cooling device 4 has a bead position detector 21, a temperature-difference detector 31, a gap detector 39 for detecting the gap between the bead and the heater, a bead heater 41 and a temperature-difference detector 59 for detecting the temperature difference between the pipe metal and the bead, from which a feed-back signal issues to the below-described bead heater controlling device 51, all said devices being arranged close to the welded pipe 7 and in series from the heating coil 3 along the direction of pipe travel. Travelling speed detector 29 is mounted on the feed roller 1 which is provided on the inlet side of the heating coil 3.

In said heat-treatment apparatus, the pipe 7 is supported and fed by the feed roller 1, but because of misarranged centering in the pressing step or the influence of heat such as from welding or for like reasons, the bead may shift in a direction perpendicular to the direction of progress of the pipe 7 by about 10 to 50 mm in the case of UO steel pipe. Therefore, if the bead heater is fixed in position, there is a possibility of the bead shifting away from the heating zone of the bead heater 41. In the apparatus of the present invention, bead position detector 21 is provided as described above to drive the bead heater 41 to cause it to follow the bead which may shift away, so as to continuously heat the bead.

Figure 6:
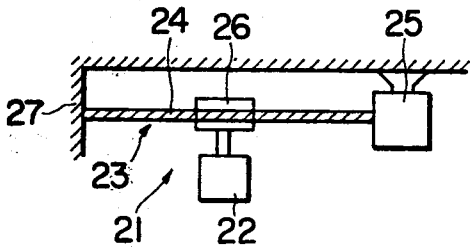
FIG. 6 is a side view of the bead position detector of the apparatus of FIG. 5.
Figure 6:
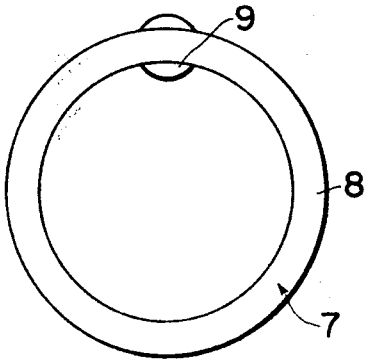

As shown in FIG. 6, the bead position detector 21 comprises radiation pyrometer 22 which is situated right above the bead 9, and driving device 23 for reciprocating said pyrometer 22 in such manner as to traverse the bead 9 through a constant stroke, say, 50 to 100 mm and at a constant speed, say, 1 to 10 cm/sec. Said driving device 23 has a frame 27 with a threaded rod 24 mounted thereon, and a motor 25 rotates said rod 24. The threaded rod 24 has a carrier 26 threadedly mounted thereon. The carrier 26 has the radiation pyrometer mounted thereon so that it reciprocates periodically due to the rotation of the threaded rod 24 in one rotational direction or the other so as to traverse the bead 9.

Figure 7:
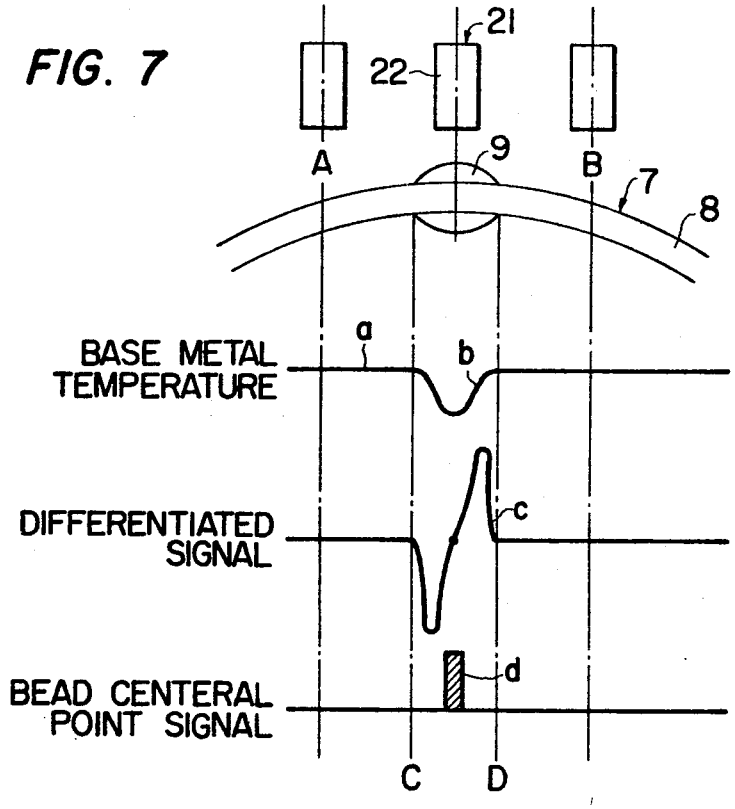
FIG. 7 is an illustration of the manner of bead position detection.

FIG. 7 shows the principle of operation of said bead position detector 21; as the bead 9 has a lower temperature than the base metal 8, said detector 21 detects the point of lowest temperature of the area around the bead over the outer surface of the welded pipe 7.

In other words, A and B in said drawing denote respectively the ends of the range of reciprocation of the radiation pyrometer 22; and C and D denote respectively the ends of the bead 9. The temperature b of the bead is lower than the temperature a of the pipe metal. The detected temperature is processed as a differentiated signal c representing temperature change for increasing the position detection sensitivity, and signal c is then converted into a pulse signal d representing the temperature at the central point of the bead.

In this embodiment, the bead position detector is constructed so as to mechanically reciprocate the pyrometer to combine the temperature signal and the position signal into a bead position signal. But it is possible to use in this place such a device that scans the area around the bead electronically or optically for a bead position signal.

As is clear from the foregoing, the bead position detector of the present invention is so constructed that the central point of the bead is detected from the temperature distribution over the area around the bead; therefore, it is possible for such detector to detect the central point of the bead with quick response and high accuracy by using an appropriate pyrometer to match the construction of the detector. Furthermore, the use of a pyrometer for the detector of the present invention makes the detector operate without damage and with the accuracy will be maintained high all the time because the pyrometer itself has a high heat resistance and makes it possible for the detector to detect the position of the bead while remaining out of contact with the pipe.

Figure 8:
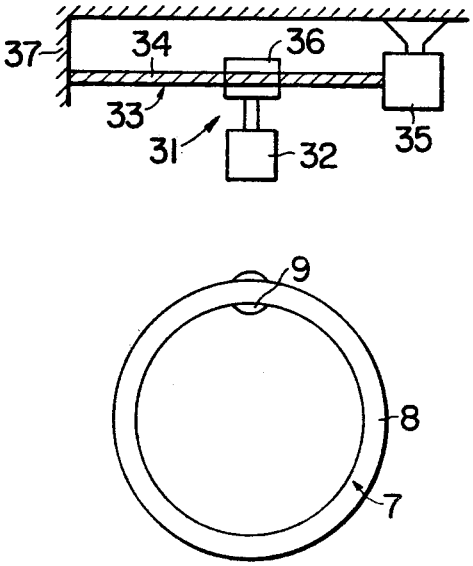
FIGS. 8 and 9 are side views respectively of the temperature difference detector and the heater of the apparatus of FIG. 5.

Temperature-difference detector 31 has a construction similar to that of said bead position detector 21. As shown in FIG. 8, radiation pyrometer 32 is mounted on the carrier 36 of a driving device 33. Screw threaded rod 34 and motor 35 are mounted on frame 37. Said carrier 36 is threadably mounted on said threaded rod 34 for free reciprocation therealong.

The temperature-difference detector 31 detects the lowest and the highest temperature of the area around the bead 9, and informs the below-described bead heater controlling device 51 of the differences between such a temperature. In place of such temperature-difference detector, there can be used a device having a plurality of pyrometers for detecting the temperature difference or a device for detecting the temperature difference by scanning the area around the bead 9 electronically or optically. Also, as the temperature-difference detector has a construction similar to that of said bead position detector 21, one such device can be used for both purposes.

Figure 9:
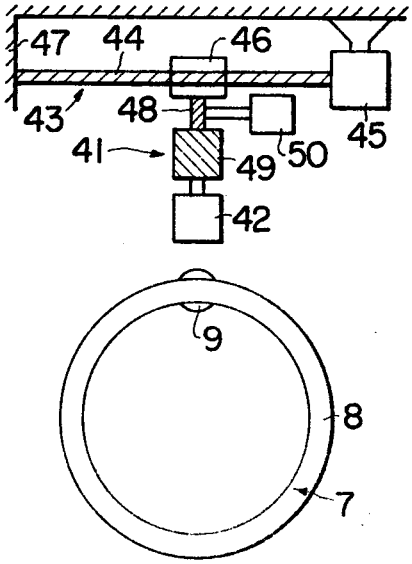

As shown in FIG. 9, bead heater 41 comprises a high-frequency induction coil 42 for locally heating the bead 9, and a tracking device 43 for transferring said coil 42 to a point situated at the shortest distance from the bead 9. The tracking device 43 has the frame 47 with threaded rod 44 and motor 45 mounted thereon, the motor 45 rotating the rod 44. The threaded rod 44 has a carrier 46 mounted thereon. The carrier 46 reciprocates back and forth with the rotation of the threaded rod 44, such rotation being produced in response to signals issuing from the bead heater controlling device.

Said carrier 46 has a threaded rod 48 extending downward therefrom and is mounted on carrier 46 for free rotation; and said threaded rod 48 has carrier 49 thereon on which is mounted the induction heating coil 42. The threaded rod 48 is connected to a motor 50, so that the carrier 49, that is, the induction heating coil 42 moves up or down during the rotation of the threaded rod 48.

In place of such high-frequency induction coil, a gas burner can be used as the heater. The source of the driving force is not limited to a motor, but can be a hydraulic cylinder, hydraulic motor, air motor or the like.

The temperature-difference detector 59 for providing a feed back signal has the same construction as the temperature-difference detector 31.

Figure 10:
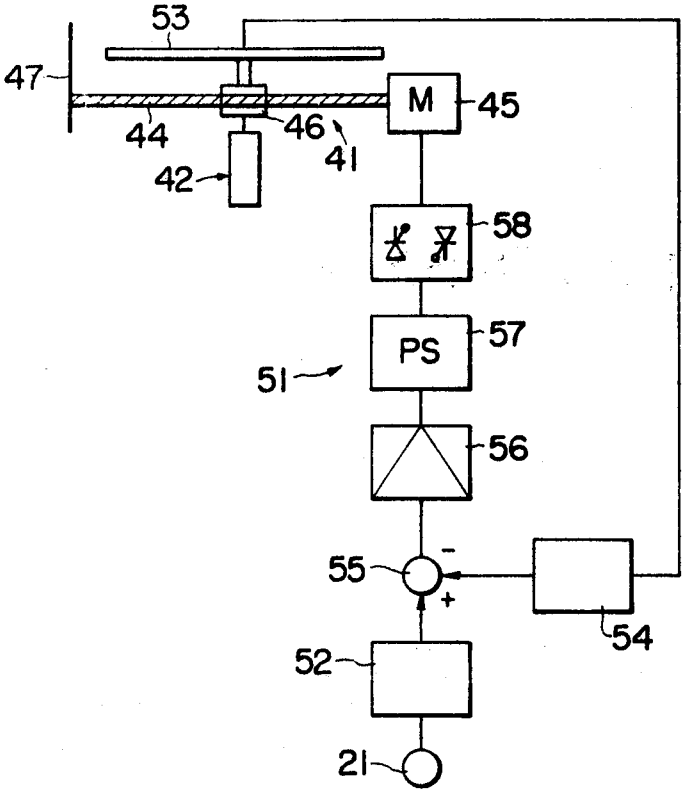

FIG. 10 is a block diagram of the bead heater controlling device 51 for controlling the operation of said bead heater 41.

In the drawing, signals issuing from the bead position detector 21, are sent to bead center signal generating circuit 52. As described above, the bead 9 has a temperature lower than that of the pipe metal 8; therefore, it is possible by detecting the position of the lowest temperature to use this as the central point of the bead 9. The center signal generating circuit 52 detects the position of lowest temperature in terms of the time taken for reciprocation of the radiation pyrometer 22, that is, in terms of the temperature-change over a sequence of positions in a direction perpendicular to the direction of pipe travel, and said circuit 52 puts out a pulse signal representing the central point of the bead 9.

The bead heater controlling device 51 is equipped with a position-signal-feedback detector 53 connected with the carrier 46 of the bead heater 41. The position signal issuing from said detector 53 is sent through feedback position signal processing circuit 28, to a comparator 55 where said position the signal is compared with signal issuing from said bead center signal generating circuit 52 and the resulting position difference signal is sent to amplifier 56. The smplified signal from the amplifier 56 is sent to a thyrister device 58 through a phase shifter 57. The thyrister device 58 operates on a gate pulse with a controlled phase angle, for controlling the rotation speed of the motor 45. Thus, the induction heating coil 42 moves in the direction perpendicular to that of pipe travel while being controlled so as to maintain its position at all times right above the bead 9, that is, at the shortest distance from the bead 9.

The gap between the bead 9 and the induction heating coil 42 is controlled in the same manner as described above. That is to say, having received a signal issuing from the gap detector 39, bead heater controlling device 51 issues an actuating signal to the motor 50 to control the rotation thereof, thereby controlling the gap between bead heater 42 and the bead. However, such gap control is not indispensable for the practice of the method of the present invention.

Figure 11:
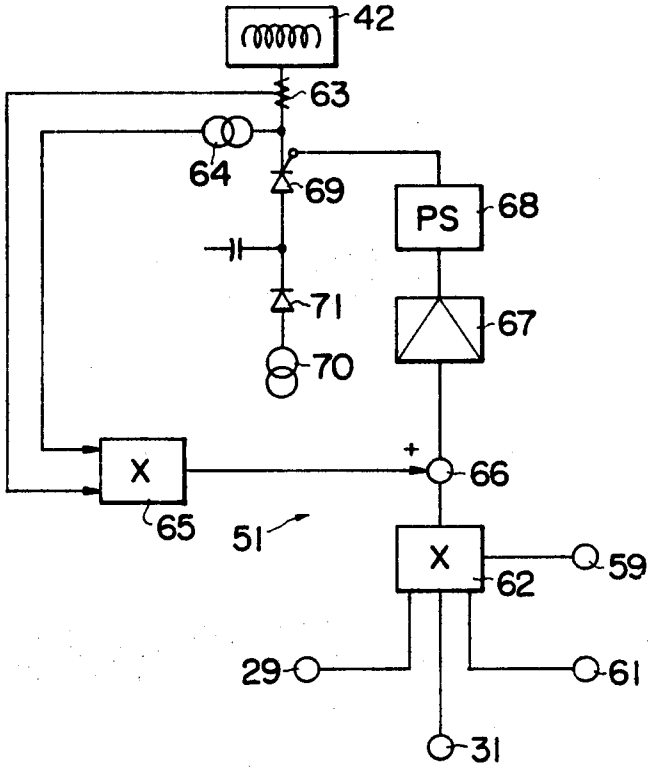
FIGS. 10 and 11 are block diagrams respectively of the tracking control section and the output control section of the bead heater control apparatus.

FIG. 11 is a block diagram of the heater output controlling section of the bead heater controlling device 51. Signals issuing from said travelling speed detector 29, temperature-difference detector 31, temperature-difference detector 59 and a bead factor setting device 61 with which is set the bead factor which influences the heating temperature, are fed into a desired output power calculator 62.

The factor is determined by the wall thickness and the characteristics of the pipe and also by the width and thickness of the bead. The output power $P_i$ from the bead heater control device 5 (shown in FIG. 11), that is, the output from the output power calculator 62 in FIG. 11, is determined by using the following formula:

$$P_i = k1/\eta\rho cW(t + \Delta t)\Delta T \cdot V \ldots \quad (1)$$

where:

$P_i$: output power from the bead heater (KW)

k: a constant according to the unit of the respective factors.

$\eta$: electrical efficiency, that is, a constant determined by the shape of the heating portion of the coil of the bead heater, the distance between said portion of the bead heater and the weld bead and the specific resistance of the weld bead.

$\rho$: specific weight of the pipe.

c: specific heat of the pipe.

W: Width of the weld bead (deemed to be substantially constant for a given size of pipe).

t: thickness of the base metal of the pipe (deemed to be substantially constant for a given size of pipe).

$\Delta t$: increase of thickness of weld bead over thicknes of base metal of pipe (see FIGS. 1*a* and 1*b*).

$\Delta T$: difference between the temperature of the base metal and the lowest temperature of the weld bead (Signal 31 shown in FIG. 11).

V: travelling speed of the pipe (Signal 29 shown in FIG. 11).

In the foregoing formula, bead factor is respresented by the term $\{k1/\eta\rho cW(T+\Delta t)\}$. . . (2).

For a given size and chemical composition of the pipe the various components of the bead factor should remain constant, and so the bead factor is deemed to be substantially constant. In such case, therefore, bead factor is calculated by using formula (2) prior to heat treatment, and then set into the bead factor setting device 61. The power output is then controlled by the temperature difference $\Delta T$ and the speed V of the pipe, which are supplied to power calculator 62 by speed detector 29 and temperature difference dectors 31 and 59.

In the course of heat treatment, it is possible that because of variations in the width and thickness of the weld bead and electrical efficiency due to changes in actual diameter among pipes of the same nominal diameter, the actual value of the bead factor may deviate from the value present in the bead factor setting device 61, causing the temperature of weld bead to deviate from the allowable range. In such case the bead factor must be reset in setting device 61.

Also, the power supplied to the induction heating coil 42 is indicated by operating signals from a high-frequency ammeter CT 63 and high-frequency voltmeter PT 64 supplied to a high-frequency output power calculator 65. Signals from the two calculators 62 and 65 are compared by the comparator 66, from which a difference signal issues which is sent to output controlling amplifier 67. The amplified signal issuing from said amplifier 67 is sent to a thyristor inverter 69 through a phase shifter 68. The thyristor inverter 69 controls the output from a transformer 70, such output having been rectified by a rectifier 71, so as to control input into the induction heating coil 42.

As is clear from the foregoing description, the apparatus for heat treatment of welded pipe according to the present invention has a temperature-difference detector 31 for detecting the temperature difference between the pipe metal 8 and the bead 9, provided between the heating device 3 and the cooling device 4, and also has a bead heater 41 for locally heating the bead 9 to make up the temperature difference between the pipe metal 8 and the bead 9 in response to signals issuing from the temperature-difference detector 31, thereby making it possible to produce a very much smaller temperature difference between the pipe metal 8 and the bead 9 then when using the conventional apparatus. Also, in the apparatus of the present invention, there is provided a device to place the induction heating coil 42 as close as possible to the bead 9 in response to signals issuing from the bead position detector 21, thereby making the heating of the bead 9 accurate and economical in heat use efficiency.

Because the pipe 7 travels at a comparatively high speed (say 0.2–2 m/min), said bead position detector 21 is required to respond quickly. Because the bead has a small width, said detector is also required to operate with considerable accuracy. Also, because it is subjected to a high temperature, the detecting section of the bead position detector 21 is required to be heat-resistant. In the following embodiment, the present invention provides a bead position detecting device which is quick-responsive and has high accuracy, and is heat-resistant.

Figure 12:
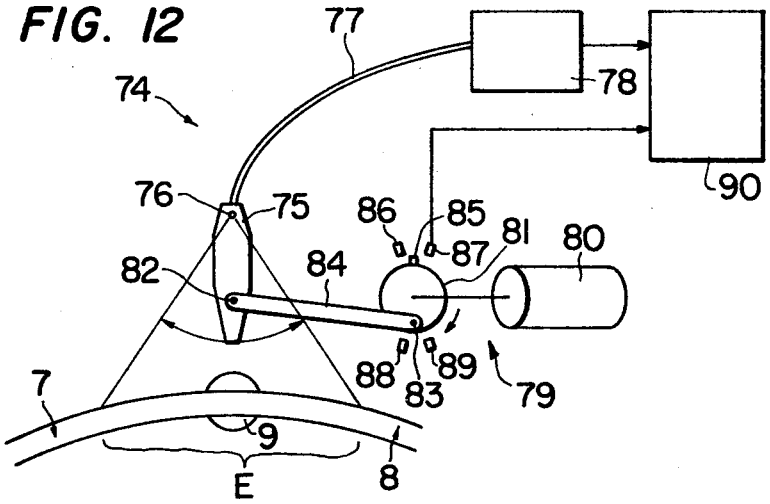
FIG. 12 is a schematic side view of one embodiment of the bead position detector of the present invention.

In FIG. 12, temperature detector 74 is a combination fiber scope and optical pyrometer. The optical nozzle 75 of the fiber scope acting as the temperature detecting section of the detector 74 has the tip thereof in close proximity to the surface of the pipe 7 and the rear end supported for free rotation on pin 76. The optical pyrometer 78 is a two color eye pyrometer or a similar type radiation pyrometer; it detects the temperature of the area around the bead 9 by light sent from the optical nozzle 75. Thus, use of the fiber scope protects the optical pyrometer 78 from exposure to high temperatures.

A driving device 79 has a disk 81 which is driven by motor 80. Said disk 81 is connected with said optical nozzle 75 by an arm 84 which rotates freely around pin 82 provided close to the lower end of the optical nozzle 75 and also around pin 83 provided close to the circumference of the disk 81. Thus, the rotation of the disk 81 causes the optical nozzle 75 to oscilate around pin 76. During such oscillation the tip of the optical nozzle 75 reciprocates in the direction perpendicular to that of pipe travel traversing the bead 9 within the area E around the bead 9. Also, on the circumferance of the disk 81, there is provided a projection 85 for detecting the angular position of disk 81. Furthermore, there are provided four proximity switches 86–89 around the periphery of disk 81 for detecting said projection 85 when the tip of the optical nozzle 75 is positioned close to either side of the bead 9.

Signal processing circuit 90 detects the central point of the bead in response to a temperature signal issuing from the optical pyrometer 78 and reference position signals issuing from the proximity switches 86–89. Where the temperature of the weld is less than that necessary for heating of welding beads as shown in FIG. 13 (II) for example, the temperature signals derived from detector 74 through fibers 77 by optical pyrometer 78 are compared with standards S previously set in the processing circuit 90, and are converted into pulse signals representing a low temperature range.

Figure 13:
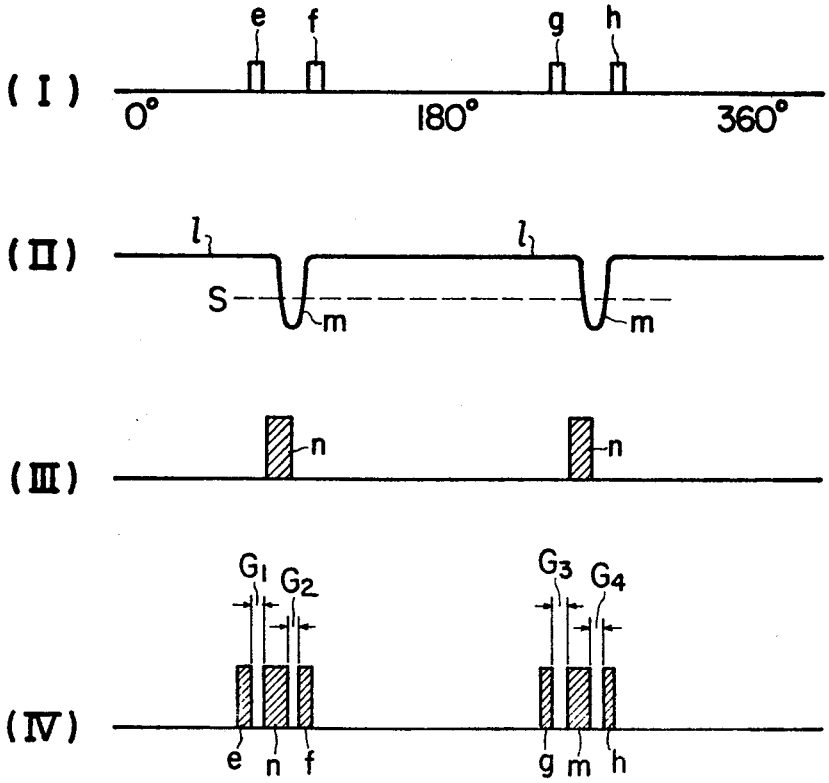
FIGS. 13I—13IV are signal wave forms for signals processed by the apparatus of FIG. 12.

On the other hand, the signals from the proximity switchs provided around disk 81 while the pyrometer is made to reciprocate at a certain period and the pulse signals issuing therefrom (FIG. 13 (I)) are combined with said temperature pulse signals into pulse signals as shown in FIG. 13 (IV), the formed gaps $G_1$, $G_2$, $G_3$, $G_4$ . . . making it possible to detect the center of the bead; and these pulse signals are input as bead position signals into the bead heater controller shown in FIG. 10.

The function of the processing circuit 90 can thus be summarized, as follows:

(i) the temperature of the weld is converted into differential signals, which are converted into pulse signals representing the positions of beads.

(ii) said pulse signals are combined with pulse signals from the proximity switchs.

(iii) the position of the bead is detected in the light of the thus combined signals and bead position signals are issued. FIG. 13 shows the signal wave forms for illustrating the processing of such temperature signal and reference position signals.

In FIG. 13 (I), the full periphery (360°) of the disk 81 is developed into a straight horizontal line; e, f, g and h denote the respective pulse signals issuing from the proximity switches 86–89 to show reference positions, when said switches 86–89 have detected said projection 85. In FIG. 13 (II), l and m denote the respective output signals issuing from the optical pyrometer 78 to represent the respective temperatures of the pipe metal 8 and the bead 9. The temperature signal m is used only when it is below a fixed level S in the circuit 90; and then the thus used signal is converted to a pulse signal n shown in FIG. 13 (III).

Then, the pulse signals e, f, g, and h representing such reference positions and the pulse signal n representing the low-temperature section are combined as shown in FIG. 13 (IV). As described above, the optical nozzle 75 and the disk 81 are connected so that during operation, the position-shifting of the bead 9 is detected by the sizes of the gaps $G_1$, $G_2$, $G_3$ and $G_4$ between the pulse signal n representing the low-temperature section and, respectively, the pulse signals e, f, g and h representing the reference positions, thereby making it possible to detect the central point of the bead 9. Furthermore, a signal representing the central point of the bead issues from the signal processing circuit 90, and is sent to said bead heater controlling device 51. The induction heating coil 42 is tracked by said controlling device 51, so as always to be positioned right above the bead 9.

The following is a description of specific embodiments of the method of the present invention:

EXAMPLE 1

For heat treatment of welded pipe ($t \times 762\ \phi \times 12000$ mm) formed by the UO process with the heat treatment being carried out in the same apparatus as for the formation of the pipe, the method of the present invention was carried with an apparatus in which a bead heater comprising a high-frequency induction heating coil was provided at a position close to the bead of the pipe between the induction heating coil and the cooling device as shown in FIG. 3. The conditions were as follows:

Heat treatment conditions: 910° C.; no retention time.
Pipe travelling speed: 600 mm/min.
Type of bead heater: Heating coil of hair pin type.
Capacity of bead heater: Output 52 KW
Size of pipe: t × 762 $\phi$ × 12000.

Figure 14:
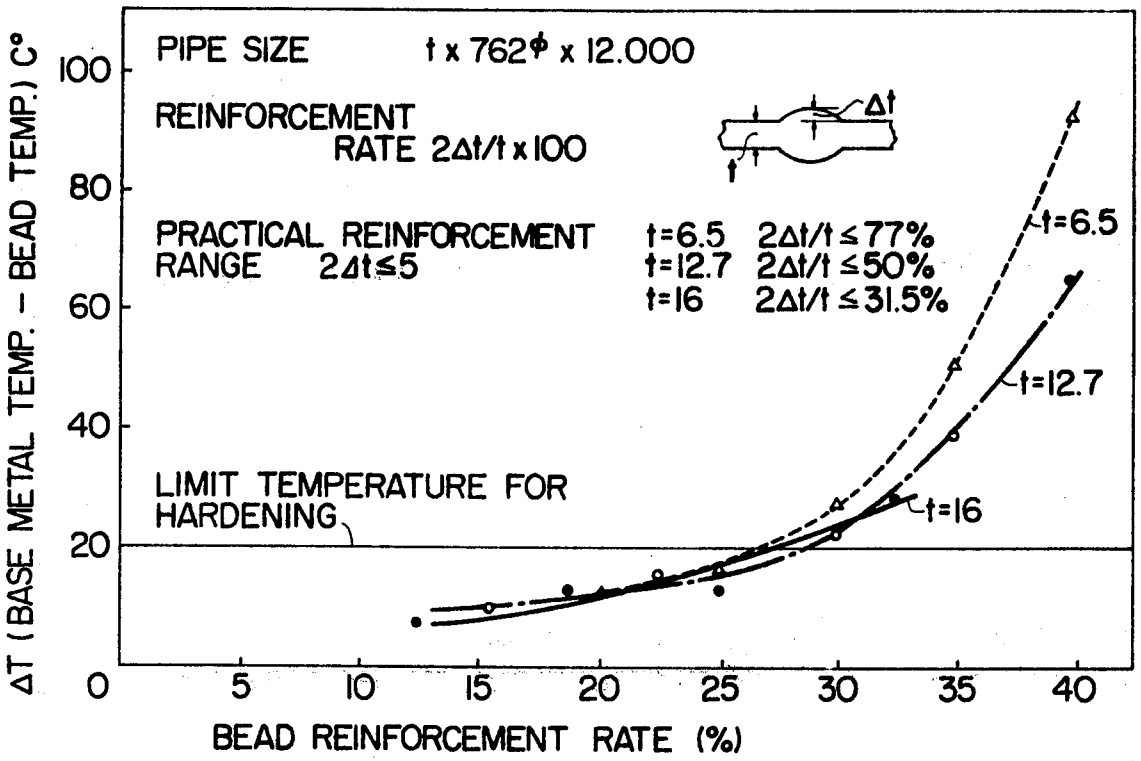
FIG. 14 is a graph of the temperature difference between the pipe metal and the bead after the welded pipe has been heated by a heating coil, relative to reinforcement rates.
Figure 15:
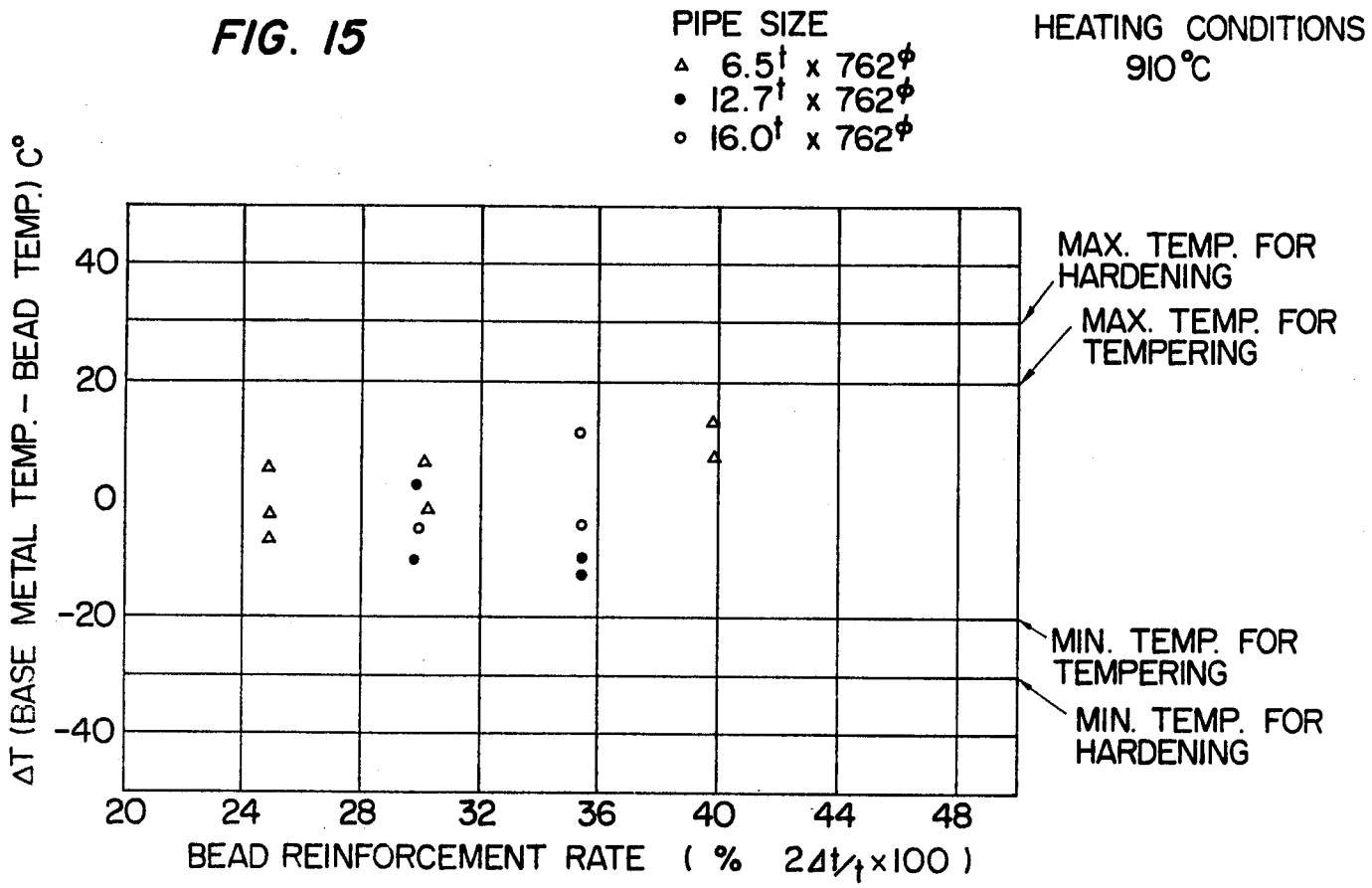
FIG. 15 is a graph of the temperature difference between the pipe metal and the bead relative to the reinforcement rates according to the method of the present invention and using the apparatus of the present invention.

The temperature difference between the pipe metal and the bead after the pipe was heated by the heating coil, was as shown in FIG. 14 with the wall thickness of the pipe and the reinforcement rate of the bead taken into consideration. Such temperature difference was reduced to the following levels by heating the bead by the bead heater as shown in FIG. 15:

The temperature of the outer surface of the bead: Less than 20° C. higher than the temperature of the base metal.

The temperature of the outer surface of the bead: More than 20° C. lower than the temperature of the base metal.

EXAMPLE 2

For continuous heat treatment of welded pipe (10 mm × 762 mm × length) formed by a spiral process on the same line as for the formation of the pipe, the method of the present invention was carried out with an apparatus having a bead heater comprising a high-frequency induction heating coil provided at a position close to the bead of the pipe between the induction heating coil and the cooling device as shown in FIG. 4. The conditions were as follows:

Size of steel pipe: 10 × 762 × 1 mm.
Reinforcement rate of bead: 30%.
Heat treatment temperature: 910° C.
Capacity of bead heating: 50 KW.
Temperature of bead before heated: 870° C.
Bead heating condition: Designed output 10 KW.
Pipe travelling speed: 2.5 m/min.
The same result as in Example 1 was obtained.

We claim:

1. In a heat treatment apparatus for continuously heating and cooling welded pipe having a reinforcement weld bead therealong as the pipe is travelling in the direction of its axis, said apparatus having an induction heating device for heating the welded pipe so rapidly to a desired temperature that the weld might not be heated up to the same temperature as the remainder of the pipe at the time of the initial heating of the pipe and a cooling device arranged along the direction of the axis of the pipe, the improvement comprising, between said heating device and said cooling device in the recited order:

(a) a bead position detector for detecting the position of said bead;
(b) a first temperature difference detector for detecting the temperature difference between the bead and the material of the remainder of the pipe;
(c) a gap detector for detecting the gap between the bead and the bead heater;
(d) a bead heater connected to said temperature difference detector for locally heating the bead for reducing the temperature difference between the bead and the remainder of the pipe when the detected temperature difference is greater than an allowable temperature difference which allowable temperature difference will not adversely affect the quality of the heated pipe; and
(e) a second temperature difference detector for detecting the temperature difference between the bead and the material of the remainder of the pipe for feedback of such a detected temperature difference; said improvement further comprising:
(f) a bead heater position controlling means to which said bead position detector and said gap detector are connected and on which said bead heater is mounted for placing the bead heater as close as possible to the bead in response to signals issuing from said bead position detector and said gap detector; and
(g) a power supply control means to which said two temperature difference detectors are connected and which is connected to said bead heater for adjusting the output from the bead heater so as to make the temperature difference between the bead and the remainder of the pipe smaller than allowable limit in response to signals issuing from said temperature difference detectors.

2. The improvement as claimed in claim 1, wherein said temperature difference detector has a driving device with a carrier having a temperature detector mounted thereon; a threaded rod engaged with threads provided on said carrier; and a motor connected to said rod for rotating said threaded rod, the rotation of the threaded rod causing the carrier to reciprocate traversing above the bead.

3. The improvement as claimed in claim 1, wherein said bead position detector has a temperature detector of the non-contact type for detecting the temperature of the portion of the pipe around the bead and having detecting means adjacent said bead; a driving device coupled to said temperature detector for reciprocating the detecting means of said temperature detector in a direction perpendicular to the direction of the bead, thus traversing the bead, and for putting out reference position signals depending on the position to which the temperature detector has been moved; and a signal processing circuit connected to said temperature detector and said driving device for detecting the position of the lowest temperature as the central position of the bead.

4. The apparatus claimed in claim 3, wherein said driving device has a carrier with said temperature detector thereon; a threaded rod engaged with threads on said movable member; and a motor connected to said rod for rotating said threaded rod, the rotation of the threaded rod causing said carrier to reciprocate traversing above the bead.

5. The improvement as claimed in claim 3, wherein said bead heater has a tracking device comprising a carrier a heater mounted on the carrier, a threaded rod engaged with threads on said carrier, and a motor connected to said rod for rotating said rod; said tracking device being coupled to said bead heater controlling device for controlling the rotation of the motor in response to signals issuing from a bead heater controlling device.

* * * * *